US007201015B2

(12) United States Patent
Feldman et al.

(10) Patent No.: US 7,201,015 B2
(45) Date of Patent: Apr. 10, 2007

(54) MICRO-CHANNEL TUBING EVAPORATOR

(76) Inventors: Elan Feldman, 18800 NE. 22nd Ave., Miami, FL (US) 33180; Doron Shimoni, 20301 NE. 30th Ave., #108-5, Aventura, FL (US) 33180

( * ) Notice: Subject to any disclaimer, the term of this patent is extended or adjusted under 35 U.S.C. 154(b) by 133 days.

(21) Appl. No.: 11/068,004

(22) Filed: Feb. 28, 2005

(65) Prior Publication Data

US 2006/0191281 A1 Aug. 31, 2006

(51) Int. Cl.
*F25C 1/12* (2006.01)

(52) U.S. Cl. ..... 62/347; 62/515

(58) Field of Classification Search ..... 62/340–356, 62/515–524

See application file for complete search history.

(56) References Cited

U.S. PATENT DOCUMENTS 3,206,944 A 9/1965 Gallo
3,430,452 A * 3/1969 Dedricks et al. ..... 62/138
4,366,679 A 1/1983 VanSteenburgh, Jr.
4,378,680 A 4/1983 Garland
4,428,543 A 1/1984 Kuhn
4,459,824 A 7/1984 Krueger
4,510,761 A 4/1985 Quarles
4,549,408 A 10/1985 Lee et al.
4,590,774 A * 5/1986 Povajnuk ..... 62/347
4,803,847 A 2/1989 Koeneman et al.
4,843,827 A 7/1989 Peppers
4,916,921 A 4/1990 Fletcher
5,182,925 A 2/1993 Alvarez et al.
5,606,869 A 3/1997 Joo
5,941,091 A 8/1999 Broadbent
6,205,807 B1 3/2001 Broadbent
6,745,827 B2 * 6/2004 Lee et al. ..... 165/144
6,912,864 B2 * 7/2005 Roche et al. ..... 62/256
7,000,415 B2 * 2/2006 Daddis et al. ..... 62/255

* cited by examiner

*Primary Examiner*—William E. Tapolcai
(74) *Attorney, Agent, or Firm*—Brooks Kushman P.C.

(57) ABSTRACT

An ice cube making machine having an evaporator assembly on which ice is formed. The evaporator assembly is constructed using micro-channel tubing that provides several channels for the flow of refrigerant within the channels. Liquid refrigerant flowing through the channels causes ice to form on the outer surfaces of the micro-channel tubing over which water flows. Refrigerant vapor is circulated through the channels to release the ice cubes from the micro-channel tubing of the evaporator assembly.

16 Claims, 5 Drawing Sheets

MICRO-CHANNEL TUBING EVAPORATOR

BACKGROUND OF THE INVENTION

1. Field of the Invention

This invention relates to ice machines and more particularly to making ice on an evaporator assembly.

2. Background Art

Commercial ice machines are used in hotels, restaurants, and other public establishments.

Refrigerant passes through copper tubing in a commercial ice machine. The copper tubing is generally adjacent to an evaporator plate that comprises a flat metal plate. The evaporator plate is cooled by refrigerant flowing through the copper tubing. Ice is formed on a surface of the evaporator plate as water flows over the surface and is cooled. When the ice reaches its desired size, a hot gas defrost is run through the copper tubing and releases the ice cubes from the evaporator plate. The ice cubes fall into an ice bin after they are released and are stored for later use.

There are many problems with the commercial ice machines. There are often many parts associated with the evaporator assembly. The large number of parts contributes to ice machine break downs. Substantial maintenance is required to keep the ice machine functioning properly. Further, spare parts for ice machines are expensive to obtain or fabricate. Evaporator plates are also often constructed using thin copper or stainless steel plates that are easily damaged.

One example of an ice machine evaporator is disclosed in U.S. Pat. No. 6,205,827 to Broadbent. This patent describes an evaporator constructed from an aluminum roll-bond type evaporator plate. This evaporator is formed from a flat sheet of aluminum that has integrally formed serpentine refrigerant passages. A plastic grid is attached to one or both sides of the aluminum evaporator plate. The grid forms an array of exposed aluminum areas where the ice may form. This disclosed embodiment is relatively expensive and requires a great deal of labor to form the evaporator plate. The evaporator plate and plastic grids are expensive to replace if they are damaged.

There is a need to reduce the cost of producing an evaporator assembly and reduce the number of parts required to construct the evaporator assembly. There is also a need to increase the overall durability of the evaporator plates.

The above problems are addressed in the present invention and summarized below.

SUMMARY OF THE INVENTION

According to one aspect of the invention, an apparatus for making ice pieces is provided. The apparatus includes a refrigeration system that circulates refrigerant. The system includes a condenser that liquefies refrigerant vapor and supplies it to an evaporator assembly. Water is supplied from a water source to the evaporator assembly. The evaporator assembly has a water flow surface that is formed by an insulating sheet and a series of sections of micro-channel tubing embedded within the insulating sheet. The micro-channel tubing has a plurality of channels through which liquid refrigerant or the refrigerant vapor flows. A plurality of vertical guides are formed of an insulating material and are provided on the water flow surface of the evaporator assembly. The vertical guides are fixed to the water flow surface. Water is directed between the vertical guides so that ice pieces are formed directly on the sections of micro-channel tubing on the water flow surface.

Other aspects of the invention relate to the structure of the micro-channel tubing. Insulating walls are secured to insulating contact surfaces of the micro-channel tubing. The micro-channel tubing has end walls separating end channels from the insulating sheet. The micro-channel tubing has interior walls that separate the plurality of channels. The plurality of channels extend longitudinally throughout the length of the tubing. Liquid refrigerant flows through the plurality of channels of the micro-channel tubing to facilitate the production of ice pieces. The refrigerant vapor circulates through the plurality of channels of the micro-channel tubing to release the ice pieces from the evaporator assembly.

According to other aspects of the invention relating to the structure of the evaporator assembly, the evaporator assembly includes molded plastic or equivalent insulation barrier vertical guides that are used to direct the flow of water across the exposed walls of the micro-channel tubing. The vertical guides may be mechanically attached or attached by a bonding agent to the water flow surface of the evaporator assembly.

According to another aspect of the invention, an apparatus is provided for making ice pieces on two water flow surfaces of an evaporator assembly. The water flow surfaces of the evaporator assembly are formed by a series of sections of micro-channel tubing and a series of horizontal insulating members. The micro-channel tubing and the horizontal insulating members are arranged and fastened in an alternating series on first and second water flow surfaces. The vertical guides cross the alternating series of sections of the micro-channel tubing and the horizontal insulating members. The flow of water is then directed between the vertical guides to form ice pieces directly on each of the sections of the micro-channel tubing.

According to other aspects of the invention relating to the structure of the evaporator assembly, both top and bottom edges of the micro-channel tubing have tangs extending the length of the micro-channel tubing. Top and bottom edges of the insulating members have slots that extend the entire length of the horizontal insulating members. The tangs and slots are assembled together to attach the sections of the horizontal insulating members to the sections of the micro-channel tubing. The micro-channel tubing and the horizontal insulating members are aligned to form a continuous surface on each side so that the ice pieces may be formed on both surfaces of the evaporator assembly.

DETAILED DESCRIPTION OF THE ILLUSTRATED EMBODIMENT(S)

Figure 1:
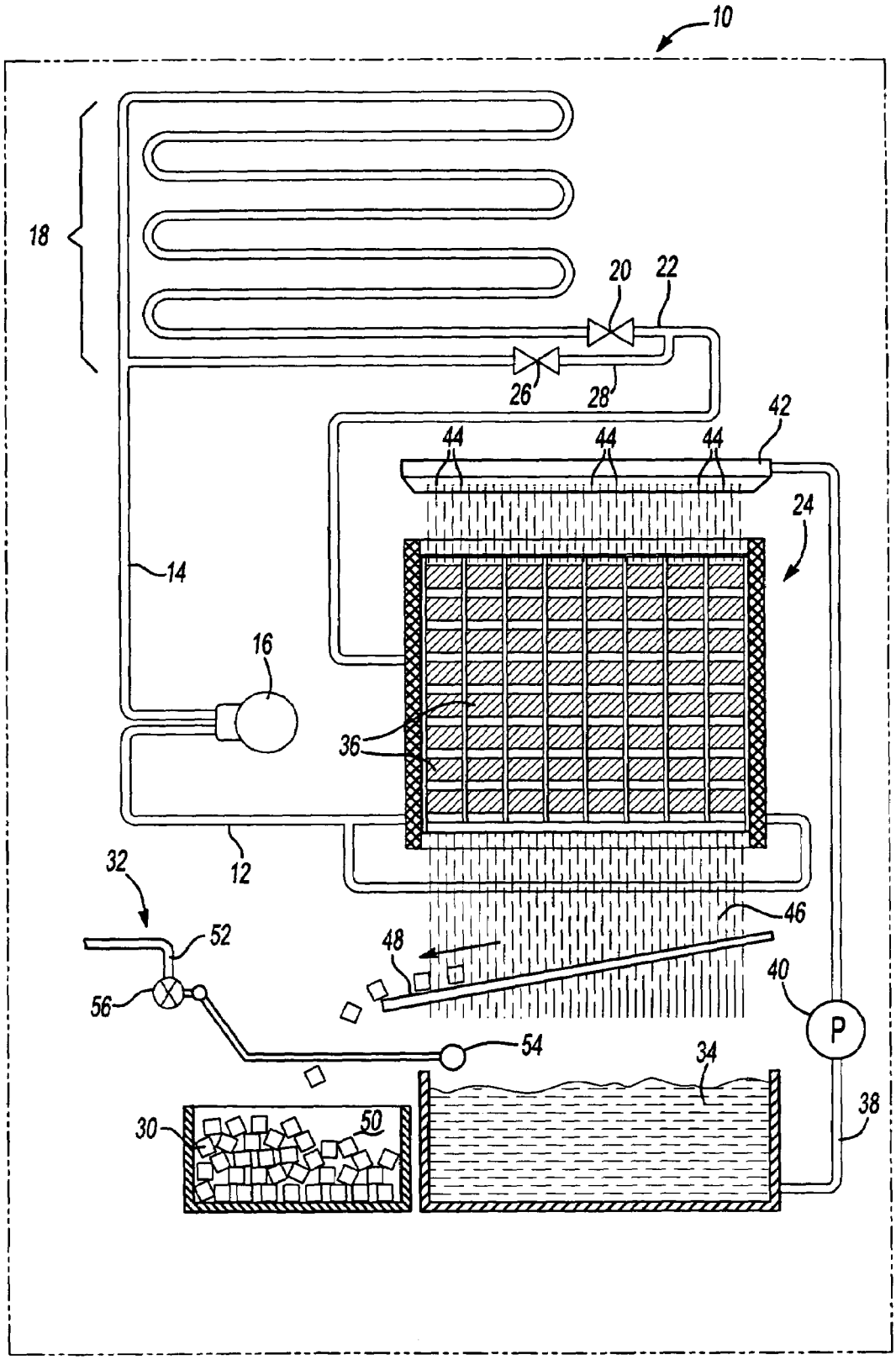
FIG. 1 is a schematic diagram of a refrigeration system having an evaporator assembly made according to one embodiment of the invention.

Referring to FIG. 1, a refrigeration system 10 is illustrated that includes a suction line 12, a discharge line 14, a compressor 16, and condenser coils 18. Refrigerant vapor is circulated through the compressor 16 to the discharge line 14. The refrigerant vapor in the discharge line 14 is then circulated through the condenser coils 18 to condense the refrigerant vapor received from the compressor 16 into a liquid refrigerant. The condenser coils 18 have a refrigerant valve 20 which is opened to circulate the liquid refrigerant through a refrigerant line 22 to an evaporator assembly 24.

A hot gas valve 26 in a hot gas line 28 are provided to control circulation of refrigerant vapor in the refrigerant line 22. Refrigerant vapor in the refrigerant line 22 may then be circulated to the evaporator assembly 24 to release ice pieces 30 from the evaporator assembly 24 once the ice pieces 30 reach a desired size.

FIG. 1 also shows the distribution of water through the refrigeration system 10. Water is first supplied to the refrigeration system 10 from a water supply 32. Water is then stored in a water basin 34 until it is distributed to a water flow surface 36 on the evaporator assembly 24. Water flows from the water basin 34 to a recirculating line 38. The water in the recirculating line 38 is pumped by a water pump 40 to a water distributor 42. The water distributor 42 distributes water over the water flow surface 36 of the evaporator assembly 24. Small holes 44 may be provided across the length of the water distributor 42 which is directly above the evaporator assembly 24. Water is relatively evenly distributed over the length of the water flow surface 36 of the evaporator assembly 24.

Water runoff 46 that does not freeze on the surface of the evaporator assembly 24 flows through a mesh ice ramp 48 to the water basin 34.

Water that freezes on the evaporator assembly 24 accumulates and forms into the ice pieces 30. The refrigerant vapor in the hot gas line 28 may be circulated through the evaporator assembly 24 to release the ice pieces 30. The ice pieces 30 released fall to the ice ramp 48. The ice ramp 48 directs the ice pieces 30 to an ice bin 50. The ice bin 50 maintains a freezing temperature for the ice pieces 30 for long term storage purposes.

The water supply 32 has a water supply line 52, a water float 54, and a float valve 56. The water float 54 remains on the surface of the water similar to a buoy in a large body of water. When the water level in the water basin 34 rises, the water float 54 rises and closes the float valve 56. When the water in the water basin 34 falls below a certain level, the water float 54 lowers and opens the float valve 56. When the float valve 56 is opened, water flows through the water supply line 52 to the water basin 34. When the water basin 34 is sufficiently full, the float valve 56 closes and stops the flow of water to the water basin 34.

Figure 2:
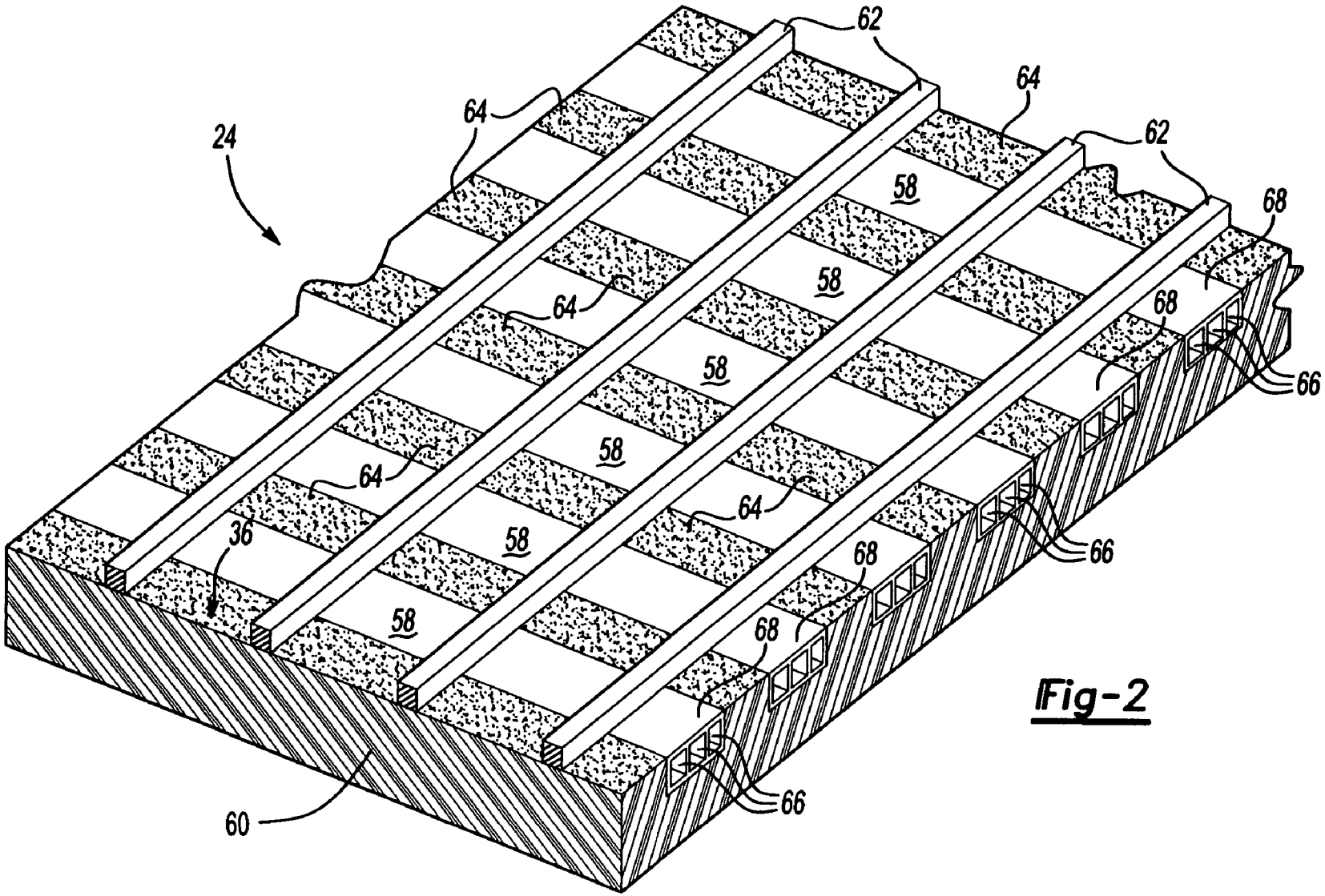
FIG. 2 is a front plan view of the evaporator assembly as illustrated in FIG. 1 that shows an evaporator inflow line and an evaporator outflow line.

Referring now to FIG. 2, the evaporator assembly 24 has, among other features, micro-channel tubing 58, an insulating sheet 60, and vertical guides 62. As water flows on the water flow surface 36 of the evaporator assembly 24, the vertical guides 62 create distinct water flow channels 64 on the water flow surface 36. The vertical guides 62 may be mechanically attached or attached by a bonding agent to the water flow surface 36 of the evaporator assembly 24. Water flowing over the water flow surface 36 is cooled by the liquid refrigerant circulated through the micro-channel tubing 58. The liquid refrigerant is circulated through a plurality of channels 66 in the micro-channel tubing 58. Once the water on the water flow surface 36 of the micro-channel tubing 58 freezes, it forms into the ice pieces 30 on freezing sites 68 on the micro-channel tubing 58.

Figure 3:
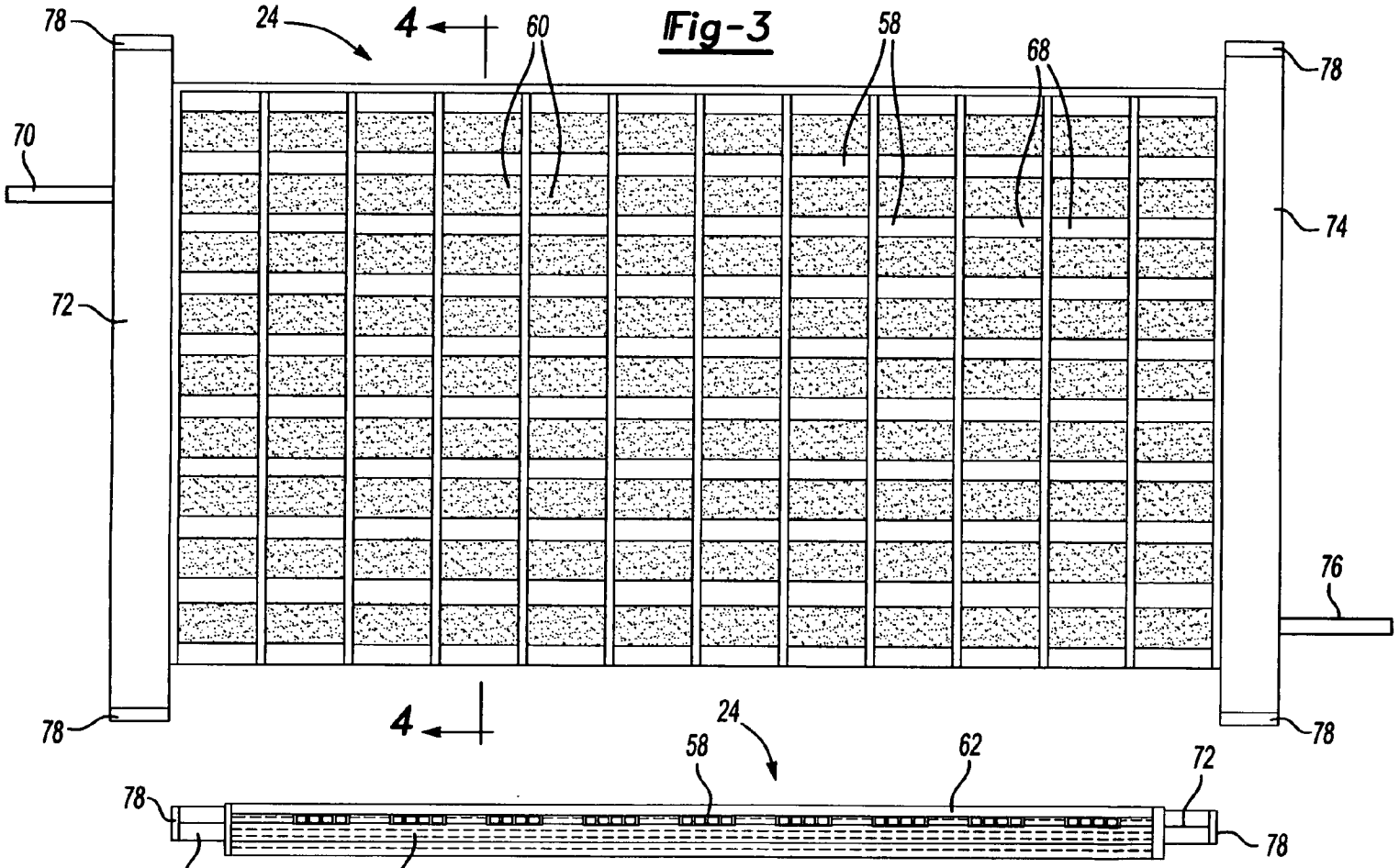
FIG. 3 is a plan view of the evaporator assembly.

Referring to FIG. 3, the liquid refrigerant or the refrigerant vapor enters the evaporator assembly 24 through an evaporator inflow line 70. The refrigerant or the refrigerant vapor flows into a first enclosed refrigerant chamber 72 which distributes the refrigerant or the refrigerant vapor to the micro-channel tubing 58. The refrigerant vapor enters a second enclosed refrigerant chamber 74 after exiting the micro-channel tubing 58. The refrigerant or refrigerant vapor then exits the evaporator assembly 24 through an evaporator outflow line 76. The first and second enclosed refrigerant chambers 72, 74 have end caps 78 to seal the ends of the chambers.

Figure 4:
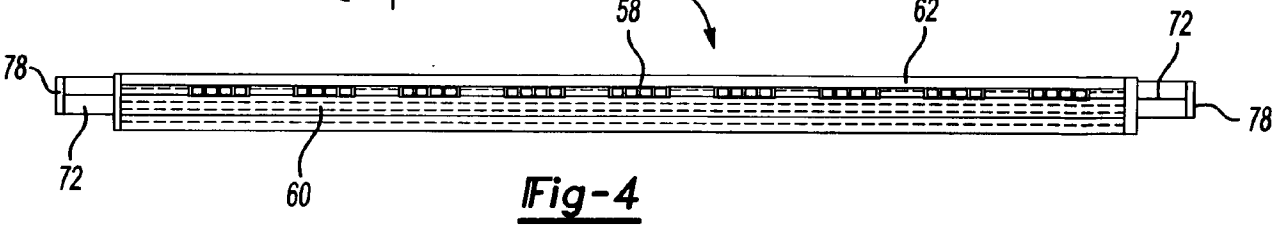
FIG. 4 is a cross-sectional view taken along line 4—4 in FIG. 3 showing micro-channel tubing embedded within the surface of an insulating sheet on the evaporator assembly.
Figure 5:
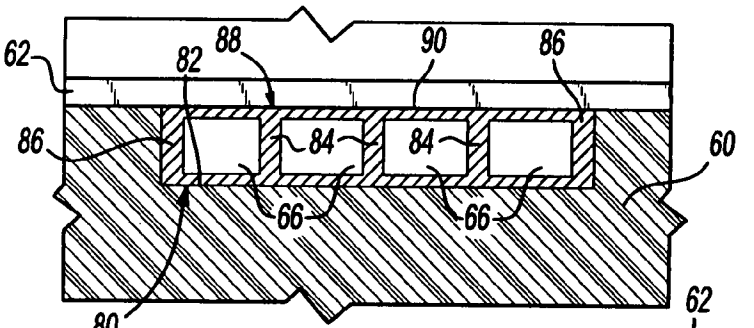
FIG. 5 is a fragmentary end view showing the orientation of the micro-channel tubing in the evaporator assembly and channels for the flow of liquid refrigerant or refrigerant vapor that are separated by interior walls.

Referring to FIGS. 4 and 5, the micro-channel tubing 58 is shown embedded in the insulating sheet 60. The micro-channel tubing 58 is secured to the insulating sheet 60 by including a sealing material such as glue or an epoxy between insulating walls 80 on the insulating sheet 60 and insulating contact surfaces 82 on the micro-channel tubing 58. The plurality of channels 66 in the micro-channel tubing 58 facilitate the circulation of the liquid refrigerant and the refrigerant vapor in the evaporator assembly 24. The micro-channel tubing 58 has both interior walls 84 which separate the plurality of channels 66 and end walls 86 which separate the micro-channel tubing 58 from the insulating sheet 60. Both the interior walls 84 and the end walls 86 of the micro-channel tubing 58 provide support for an exposed surface 88 of the micro-channel tubing 58 which acts as an evaporator plate 90. This orientation permits the evaporator plate 90 of the micro-channel tubing 58 to be thinner than the evaporator plates 90 in most refrigerant systems 10. This thinner surface has better heat transfer properties and facilitates a more effective production of the ice pieces 30 on the evaporator assembly 24.

Figure 6:
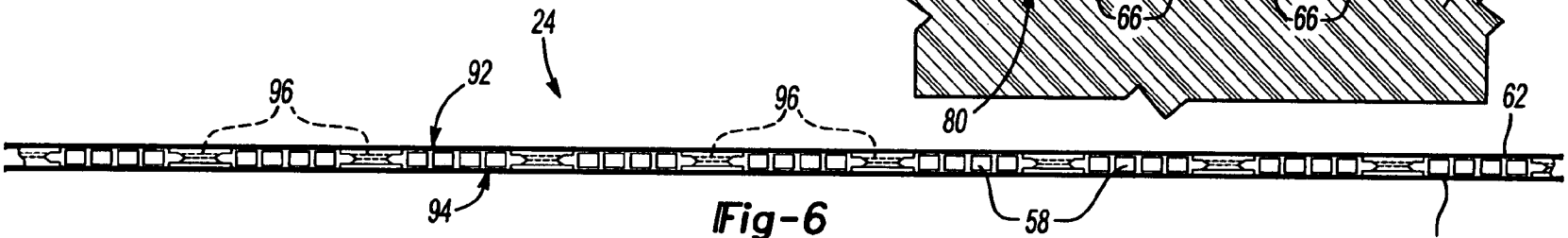
FIG. 6 is a cross-sectional view of an alternative embodiment of the evaporator assembly in a view similar to FIG. 4.
Figure 8:
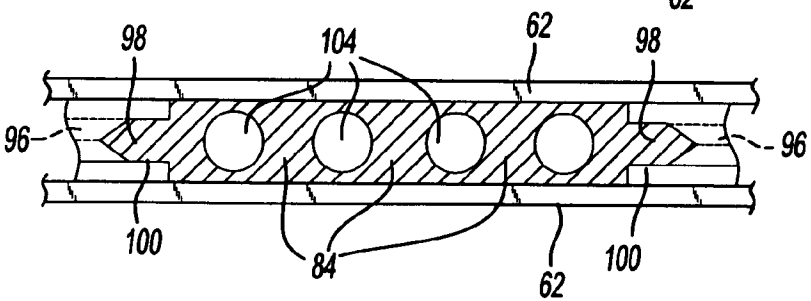
FIG. 8 is a fragmentary cross-sectional view of an alternative embodiment of an evaporator assembly having cylindrical micro-channels.
Figure 7:
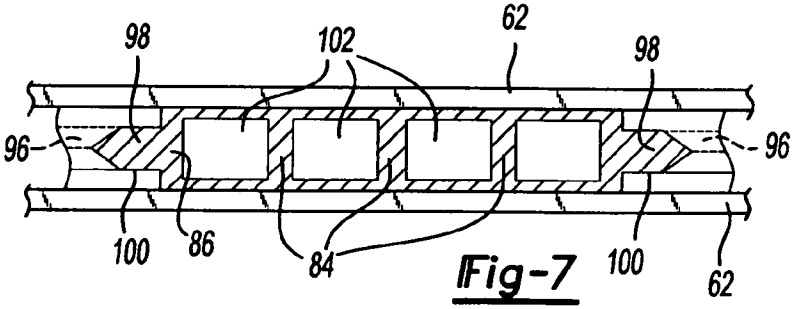
FIG. 7 is a fragmentary cross-sectional view of the evaporator assembly of FIG. 6 showing the connection between the micro-channel tubing and horizontal insulating members that form the evaporator assembly.

Referring to FIGS. 6, 7, and 8, an alternative embodiment is shown in which water flows on both surfaces of the evaporator assembly 24. This embodiment has both a first water flow surface 92 and a second water flow surface 94. The evaporator assembly 24 is oriented in a generally vertical position so that water flows in generally equal volumes over both the first and second water flow surfaces 92, 94. Water flowing over the first and second water flow surfaces 92, 94 of the evaporator assembly 24 is cooled by the liquid refrigerant circulated through the micro-channel tubing 58. Water flowing on the first and second water flow surfaces 92, 94 of the micro-channel tubing 58 freezes and forms into the ice pieces 30. The structure of this embodiment of the evaporator assembly 24 allows each length of the micro-channel tubing 58 to provide two freezing sites on opposite sides. Horizontal insulating members 96 are flush with the two sides of the micro-channel tubing 58 to create the first and second water flow surfaces 92, 94 on opposite sides of the evaporator assembly 24. This orientation also helps to maximize the heat transfer properties of the refrigerant in conjunction with the micro-channel tubing 58. Thermal energy may be wasted on the evaporator plate 88 surfaces of the micro-channel tubing 58 that are not part of the water flow surfaces. The thermal energy lost to the non-water flow surfaces is reduced by providing two water flow surfaces 92, 94.

The horizontal insulating members 96 and the section of the micro-channel tubing 58 alternate to form the first and second water flow surfaces 92, 94. The micro-channel tubing 58 has tangs 98 on its top and bottom edges which extend the entire length of the micro-channel tubing 58. Slots 100 are provided on top and bottom edges of the horizontal insulating members 96 which extend the entire length of the horizontal insulating members 96. The tangs 98 of the micro-channel tubing 58 are assembled to the slots 100 of the horizontal insulating members 96. The assembly may be further secured using glue or other fastening means. The vertical guides 62 are then attached to both the first and second water flow surfaces 92, 94 of the evaporator assembly 24. The vertical guides 62 supplement or reinforce the assembly of the alternating horizontal insulating members 96 and the micro-channel tubing 58.

FIGS. 7 and 8 show alternative embodiments of the structure of the micro-channel tubing 58. These alternative embodiments which are characterized by rectangular channels 102 and cylindrical channels 104, for example, that demonstrate different channel shapes may be provided for the flow of liquid refrigerant or refrigerant vapor. These alternative shapes also reinforce the evaporator plate 90 surface of the micro-channel tubing 58. Further, different channel shapes may provide improved durability, heat transfer properties, or refrigerant flow.

Figure 9:
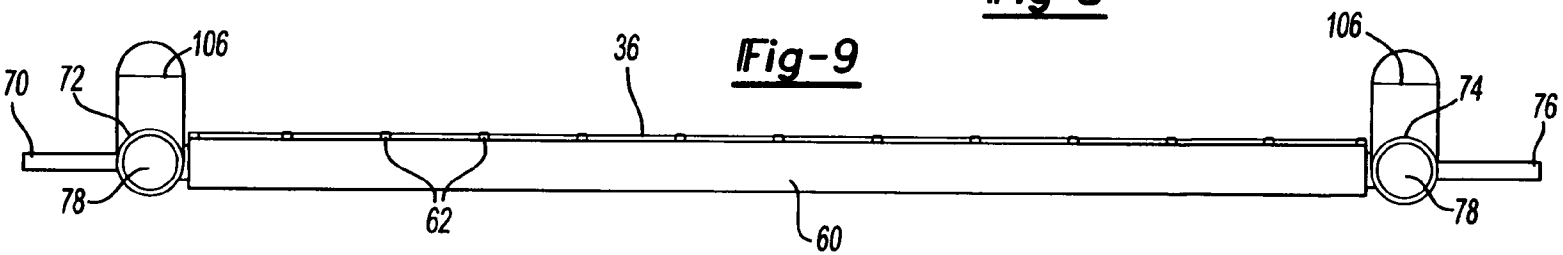
FIG. 9 is a front elevation view of the evaporator assembly.
Figure 10:
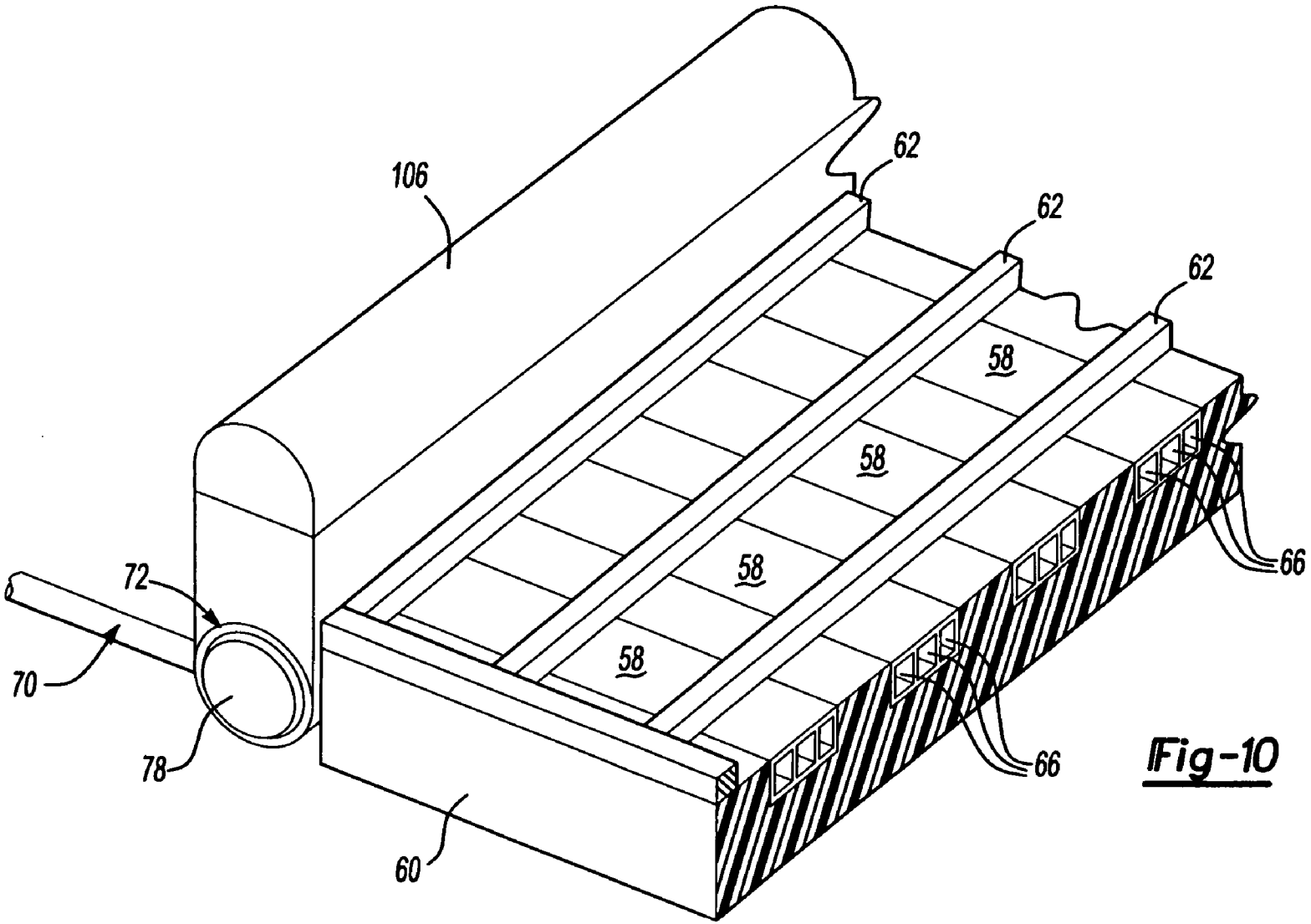
FIG. 10 is a fragmentary perspective view showing the connection of the evaporator inflow line to an enclosed refrigerant chamber that is attached to an insulating boundary that restricts the flow of water to the surface of the evaporator assembly.

Referring to FIGS. 9 and 10, the vertical guides 62 are fixed to the water flow surface 36 on the evaporator assembly 24. The insulating sheet 60 may be constructed of one large piece of plastic or other insulating material that spans the entire evaporator assembly 24. The micro-channel tubing 58 is embedded within the insulating sheet 60 and fixed to the insulating sheet 60 using glue, epoxy, or other fastening mechanisms. The liquid refrigerant is circulated through the plurality of channels 66 of the micro-channel tubing 58 to form ice pieces 30 on the evaporator plate 90 surface of the micro-channel tubing 58. An insulating boundary 106 is attached to each of the first and second enclosed refrigerant chambers 72, 74. The insulating boundary 106 ensures that the water provided to the water flow surface 36 remains within the bounds of the evaporator assembly 24.

While the embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for making pieces of ice, comprising:

a refrigeration system;

a condenser in the refrigeration system that liquefies a refrigerant vapor;

a water source that supplies a flow of water; and an evaporator assembly having a water flow surface that is formed by alternating portions of an insulating sheet and a series of sections of micro-channel tubing embedded within the insulating sheet with at least a portion of the micro-channel tubing forming part of the water flow surface, the micro-channel tubing having a plurality of channels through which liquid refrigerant or refrigerant vapor flows, and a plurality of vertical guides are provided on the water flow surface, the guides are provided on the water flow surface to direct water between the guides in a linear direction over the water flow surface to form ice directly on the sections of the micro-channel tubing on the water flow surface.

2. The apparatus of claim 1 wherein insulating walls are secured to insulating contact surfaces of the micro-channel tubing.

3. The apparatus of claim 1 wherein the micro-channel tubing has end walls separating end channels from the insulating sheet.

4. The apparatus of claim 1 wherein the micro-channel tubing has interior walls which separate the plurality of channels.

5. The apparatus of claim 4 wherein the plurality of channels extend longitudinally over the length of the micro-channel tubing.

6. The apparatus of claim 1 wherein the liquid refrigerant runs through the plurality of channels of the micro-channel tubing to facilitate the production of the ice pieces.

7. The apparatus of claim 1 wherein the refrigerant vapor runs through the plurality of channels of the micro-channel tubing to release the ice pieces from the evaporator assembly.

8. The apparatus of claim 1 wherein the vertical guides are molded plastic or equivalent insulation barrier.

9. The apparatus of claim 1 wherein the vertical guides are mechanically attached or attached by a bonding agent to the water flow surface of the evaporator assembly.

10. An apparatus for making ice pieces, comprising:

a refrigeration system;

a condenser in the refrigeration system that liquefies a refrigerant vapor;

a water source that supplies a flow of water;

an evaporator assembly having first and second planar water flow surfaces on opposite sides that are formed by a series of sections of micro-channel tubing and horizontal insulating members arranged and fastened together, a plurality of vertical guides that cross the series of sections of the micro-channel tubing and the horizontal insulating members on both water flow surfaces, wherein the flow of water is directed on both water flow surfaces between the vertical guides wherein the ice pieces are formed directly on the sections of the micro-channel tubing on opposite sides forming the first and second water flow surfaces, and wherein the sections of the insulating members divide the ice pieces into discreet deposits; and wherein both top and bottom edges of the micro-channel tubing have tangs that extend the length of the micro-channel tubing and top and bottom edges of the horizontal insulating members have slots that extend over the entire length of the horizontal insulating members to link the horizontal insulating members to the sections of the micro-channel tubing.

11. The apparatus of claim 10 wherein the micro-channel tubing and the horizontal insulating members are aligned to form a continuous surface on each of the first and second water flow surfaces to form ice on both surfaces.

12. The apparatus of claim 10 wherein the micro-channel tubing has end walls separating end channels from the horizontal insulating members.

13. The apparatus of claim 10 wherein the micro-channel tubing has interior walls which separate the plurality of channels.

14. The apparatus of claim 13 wherein the plurality of channels extend longitudinally over the length of the micro-channel tubing.

15. The apparatus of claim 10 wherein liquid refrigerant runs through the plurality of channels of the micro-channel tubing to facilitate the production of ice.

16. The apparatus of claim 10 wherein the refrigerant vapor is circulated through the plurality of channels of the micro-channel tubing to release the ice from the evaporator assembly.

* * * * *